US005241712A

United States Patent [19]

Mahoney

[11] Patent Number: 5,241,712

[45] Date of Patent: Sep. 7, 1993

[54] INVALID TOLIET SEAT

[76] Inventor: Kenneth J. Mahoney, 828 Tanglewood, East Lansing, Mich. 48823

[21] Appl. No.: 898,316

[22] Filed: Jun. 15, 1992

[51] Int. Cl.[5] ..... A61H 35/00; E03D 9/08

[52] U.S. Cl. ..... 4/420.2; 4/420.4; 4/447

[58] Field of Search ..... 4/420.1–420.5, 4/443–448

[56] References Cited

U.S. PATENT DOCUMENTS

| | | | |
|---|---|---|---|
| Re. 28,405 | 5/1975 | Sollerud . | |
| 302,334 | 7/1884 | Hanse | 4/446 |
| 426,798 | 4/1890 | Grove | 4/616 |
| 2,875,450 | 3/1959 | Umann | 4/447 |
| 3,039,117 | 6/1962 | Hoskins | 4/445 X |
| 3,545,015 | 12/1970 | Richardson, Jr. et al. | 4/447 |
| 3,995,326 | 12/1976 | Umann | 4/447 X |
| 4,237,560 | 12/1980 | Riegelmon et al. | 4/447 |
| 4,462,122 | 7/1984 | Broeils | 4/239 |
| 4,622,704 | 11/1986 | Chung | 4/443 |
| 4,638,514 | 1/1987 | Landsberger | 4/447 X |
| 4,764,997 | 8/1988 | Anderson et al. | 4/420.3 |
| 4,888,833 | 12/1989 | Garcia et al. | 4/480 |
| 4,967,423 | 11/1990 | Aoyama | 4/420.4 |
| 4,970,736 | 11/1990 | Koizumi | 1/547 X |
| 5,058,222 | 10/1991 | Workman et al. | 4/453 X |
| 5,060,325 | 10/1991 | Carnahan et al. | 4/547 X |

*Primary Examiner*—Henry J. Recla
*Assistant Examiner*—Robert M. Fetsuga
*Attorney, Agent, or Firm*—Ian C. McLeod

[57] ABSTRACT

A self-contained and portable personal hygiene apparatus (10) that aids a person to excrete or otherwise relieve themself into a toilet (12), is described. The hygiene apparatus is comprised of a toilet seat (14) that mounts on the toilet, a portable water pump (16) and a blower (18). The toilet seat is provided with a plurality of water nozzles (66) that direct a cleansing water flow from the water pump against the buttocks after the person is finished excreting into the toilet. Then, the person actuates the blower which causes a drying airflow to blow against the buttocks from a plurality of air nozzles (74) mounted on the toilet seat. After the person is cleaned, the hygiene apparatus can be disassembled and transported along with the person's other personal effects and belongings. This helps those persons that normally require assistance when they relieve themself to lead normal and active lives without the fear of being unable to relieve themself in a bathroom that is not the one that they normally use. The apparatus is adapted for use without any assistance while the person is excreting, thus providing privacy which is important.

21 Claims, 4 Drawing Sheets

INVALID TOLIET SEAT

Figure 1:
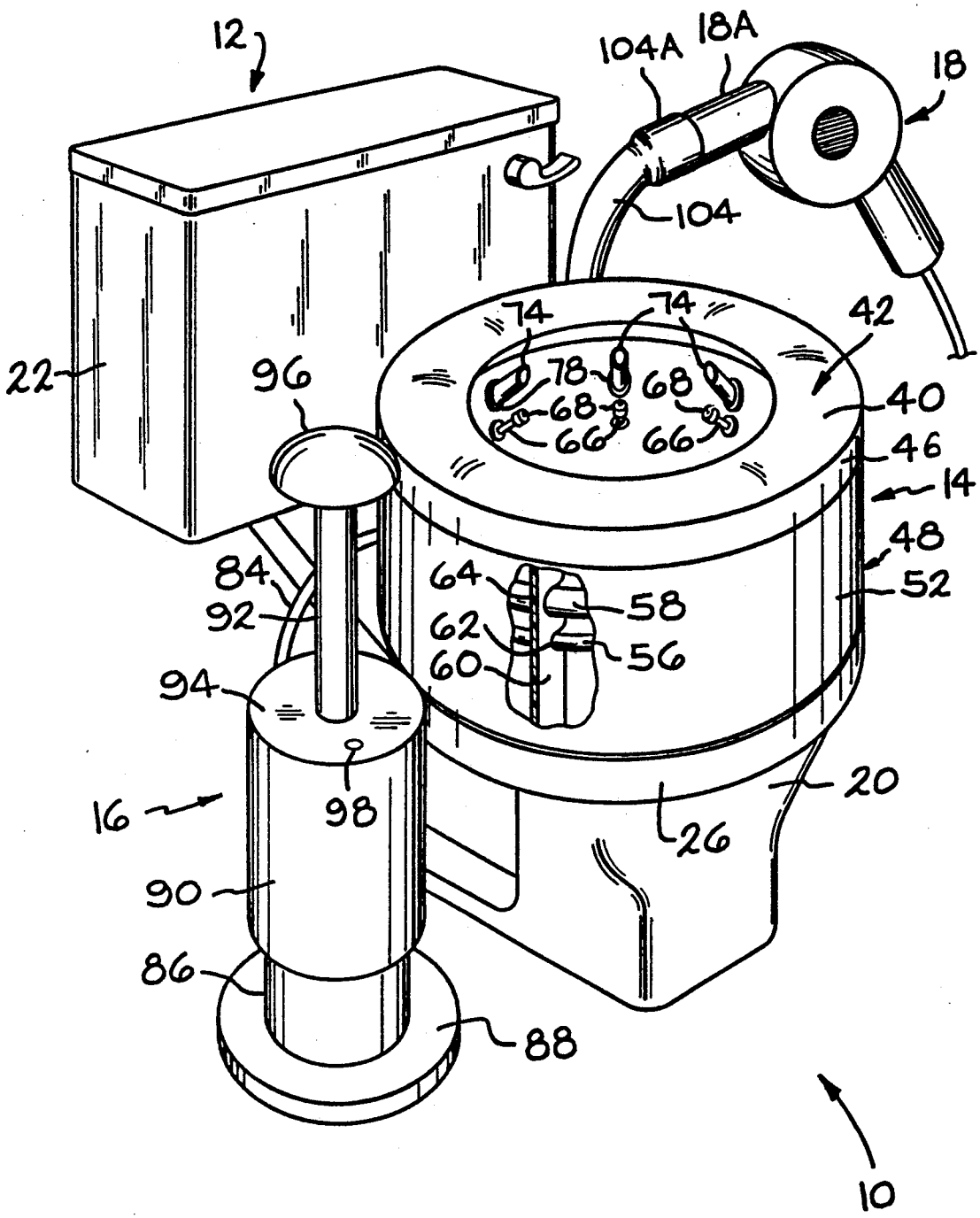

BACKGROUND OF THE INVENTION (1) Field of the Invention

The present invention relates to a personal hygiene apparatus that aids a person to relieve themself into a toilet. In particular, the present invention relates to a self-contained personal hygiene apparatus comprising a seat device that mounts on the excretion opening of a toilet to enable the person, particularly an invalid or debilitated person to relieve themself into the toilet. For invalids and debilitated persons, their own personal hygiene needs are a great concern and often the source of much apprehension. The result is that these people often remain confined to their living quarters because they are uncertain about what to do to relieve themself in a bathroom that is not their own. At home, they usually have access to an attendant who can help them with their personal hygiene needs, or their personal bathroom is equipped with a toilet having a bidet and an associated dryer unit.

The present invention solves this problem by providing a self contained and portable personal hygiene unit apparatus having a seat device that can be mounted on a toilet to aid the person in relieving themself. The seat device is a doughnut shaped member that mounts on the excretion opening of the toilet. The person then sits on the seat device and relieves themself into the toilet. To clean themself, the person actuates a portable water pump that moves a cleansing fluid to a plurality of water nozzles mounted on the seat device to provide a wash means. The nozzles serve to direct the cleansing fluid against the person's buttocks to clean and wash the buttocks. After the buttocks have been thoroughly cleaned, the person actuates a portable dryer that directs a drying airflow through a plurality of air nozzles mounted on the seat device and against the buttocks. The seat device along with the portable water pump and the portable dryer can then be packed into a travel case or suitcase and carried along with the person's other personal effects.

(2) Prior Art

The prior art has described numerous devices for aiding a person, particularly a debilitated or invalid person to relieve themself or otherwise excrete into a toilet. These include U.S. Pat. Nos. Re. 28,405 to Sollerud; U.S. Pat. No. 4,888,833 to Garcia et al; U.S. Pat. No. 4,970,736 to Koizumi; U.S. Pat. No. 5,058,222 to Workman et al; and U.S. Pat. No. 5,060,325 to Carnahan et al.

U.S. Pat. No. Re. 28,405 to Sollerud describes an apparatus for hygienically washing patients which includes a suction nozzle that is connected to a vacuum pump for sucking up intestinal excretions, vomit, etc. A bathing nozzle is connected to a pump for applying a washing fluid to the patient. This apparatus requires that the patient be laying on their stomach during the washing procedure. Also, the patient needs to be laying on a waterproof liner so that washing fluids applied to the body do not run off the patient and soak the patient's bed. This apparatus also does not have any means for drying the patient.

U.S. Pat. No. 4,888,833 to Garcia et al describes a cart for positioning a body on a toilet. The cart has a pneumatic system for raising the patient's body above the height of the toilet seat as the patient is being pushed over the toilet. The cart can then be lowered to position the patient on the toilet seat for using the toilet.

U.S. Pat. No. 4,970,736 to Koizumi describes a multifunctional bed for attending to the daily hygienic needs of an infirm patient. The bed includes an opening corresponding to a position of the stool of the patient. The patient can then urinate and/or excrete from their bowels into the stool while lying in bed. The stool can be provided with a cleaning/drying/heating seat. The bed permits the patient to clean his body by a shower through a hot water nozzle after excretion and to dry his body by means of a warm air blowing unit.

U.S. Pat. No. 5,058,222 to Workman et al describes a support structure containing a closed system for collection of excreted human wastes. The support structure comprises a seat having a waste collection apparatus that is raisable through an opening in the seat to position an interfacing saddle in contact with the patient's buttocks. The saddle is connected by a conduit to a storage container for the waste. The accumulated wastes are then sealed within the storage container, which prevents exposure of assisting personnel to possible contamination from the wastes. After the patient is finished excreting, the anal region is cleansed by a stream of cleansing fluid directed at the patient's buttocks through a nozzle positioned in the saddle. Next, a stream of air is directed through a separate opening in the saddle to dry the anal region. After the patient has been cleaned and dried, the saddle is lowered into the support structure and the seat opening is closed to provide a chair for the patient. The support structure also folds down to provide a bed.

U.S. Pat. No. 5,060,325 to Carnahan et al describes an integrated bed mattress and commode having a bathing section. The commode is provided in a cut-out section of the mattress. The patient is first moved over the mattress until their buttocks are positioned on the commode for excreting from their bowels. To clean the patient, an inflatable liner is positioned on a side of the mattress and the patient is moved onto the liner. The liner is then inflated to form a tube in which the patient can be bathed.

Another patent that is more remotely related to the present invention is U.S. Pat. No. 426,798 to Grove which describes a portable shower bath having a hand pump for providing water to the shower.

What is needed is a self-contained personal hygiene apparatus having a seat device that mounts on a toilet and aids a person, particularly an invalid or debilitated person, to excrete into the toilet. The seat device also needs to provide a means for washing and drying the individual's buttocks after the individual has finished excreting. Then the hygiene apparatus needs to be portable so that the seat device along with a hand pump, as the wash means and a blower as the dryer means can be carried or transported along with the person's other belongings. This enables those persons who are not capable of attending to their own personal hygiene in the customary manner to continue to lead normal and active lives, without the fear of being unable to relieve themself in a bathroom that is not their own.

OBJECTS

It is therefore an object of the present invention to provide a self-contained personal hygiene apparatus having a seat device that enables a person to excrete into a toilet. Further, it is an object of the present invention to provide a self-contained portable personal hygiene apparatus having a seat device that mounts on an excretion opening of a toilet to enable an invalid or debilitated person to excrete into the toilet wherein after the person is finished excreting, a wash means portion of the apparatus directs a cleansing fluid at the person's buttocks and then a dryer portion directs a drying airflow at the buttocks. Still further, it is an object of the present invention to provide a self-contained personal hygiene apparatus that enables a person to excrete into a toilet and that is provided with a hand operated water pump that serves as a wash means for cleaning the person's buttocks, wherein the hand pump enables the person to regulate the amount of cleansing fluid directed at their buttocks. Furthermore, it is an object of the present invention to provide a travel unit that can be carried along with a person's personal effects and belongings, and which serves to help the person excrete into a toilet. Finally, it is an object of the present invention to provide a portable personal hygiene apparatus that is inexpensive to build, easy to use and durable in construction and that enables a person, particularly an invalid or debilitated person to excrete into a toilet and to thereafter clean and dry themself. These and other objects will become increasingly apparent by reference to the following descriptions and to the drawings.

IN THE DRAWINGS

FIG. 1 is a perspective view showing the portable personal hygiene unit 10 of the present invention comprising a toilet seat 14 mounted on a toilet 12 and a portable water pump 16 and blower 18.

Figure 2:
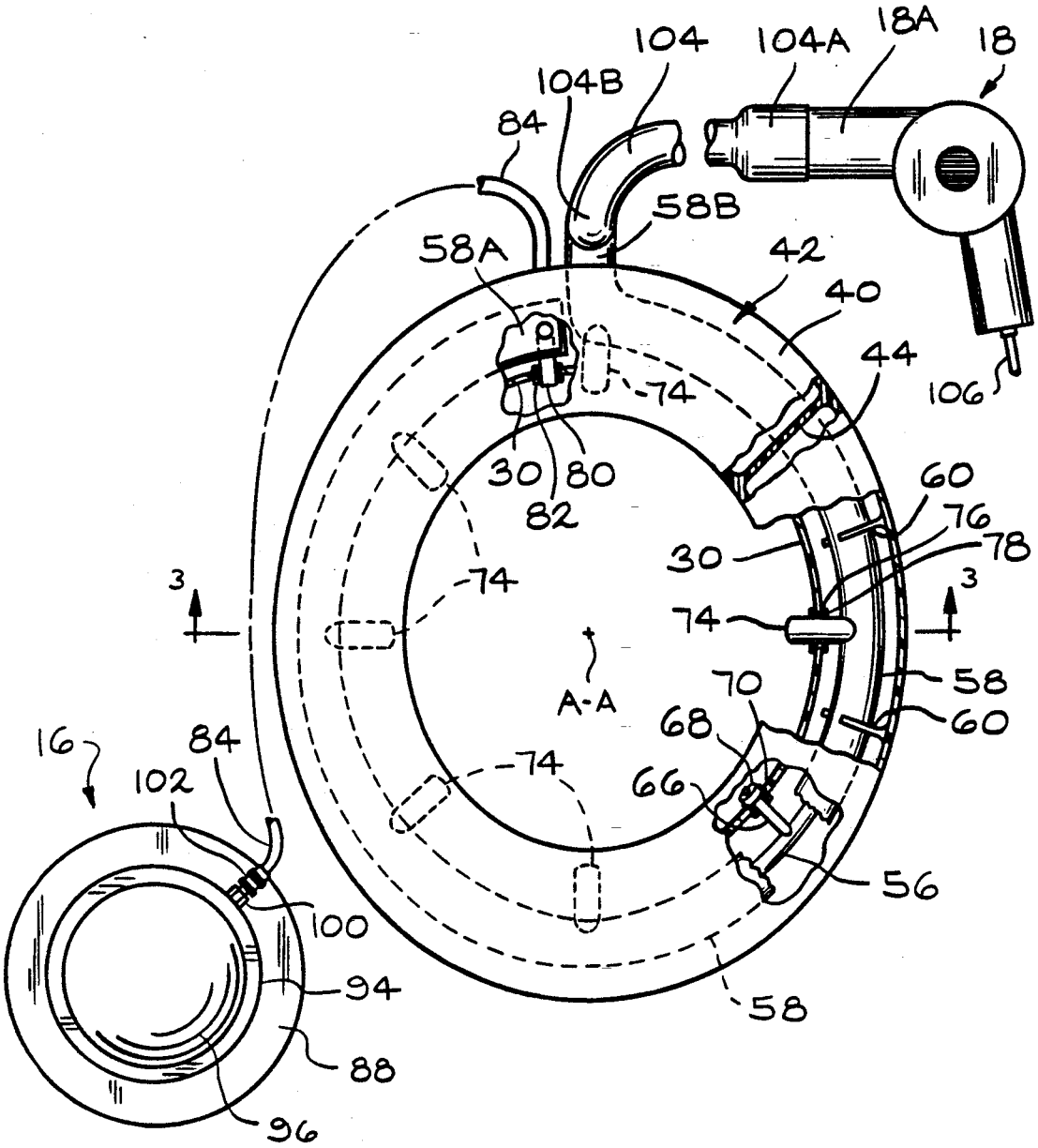

FIG. 2 is a plan partially cross-sectioned view of the toilet seat 14 shown in FIG. 1 and showing the water conduit 56 supported in the toilet seat 14 and connected to water nozzles 66 and further showing the airflow conduit 58 supported in the toilet seat 14 and connected to the air nozzles 74.

Figure 3:
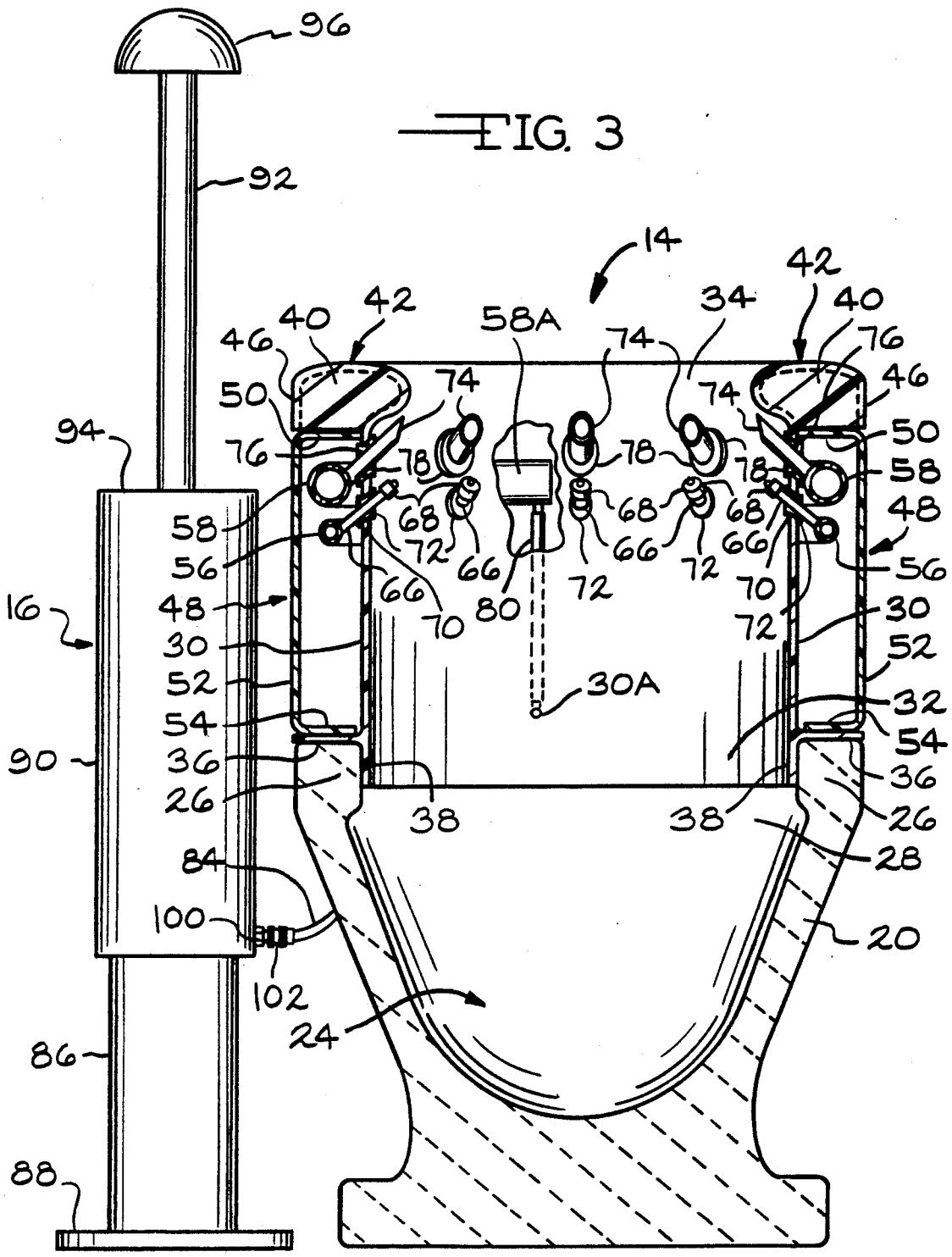

FIG. 3 is a cross-sectioned view along line 3—3 of FIG. 2 showing the toilet seat 14 mounted on the toilet 12 with the water conduit 56 supported in the toilet seat 14 and connected to the water nozzles 66 and the airflow conduit 58 supported in the toilet seat 14 and connected to the air nozzles 74.

Figure 4:
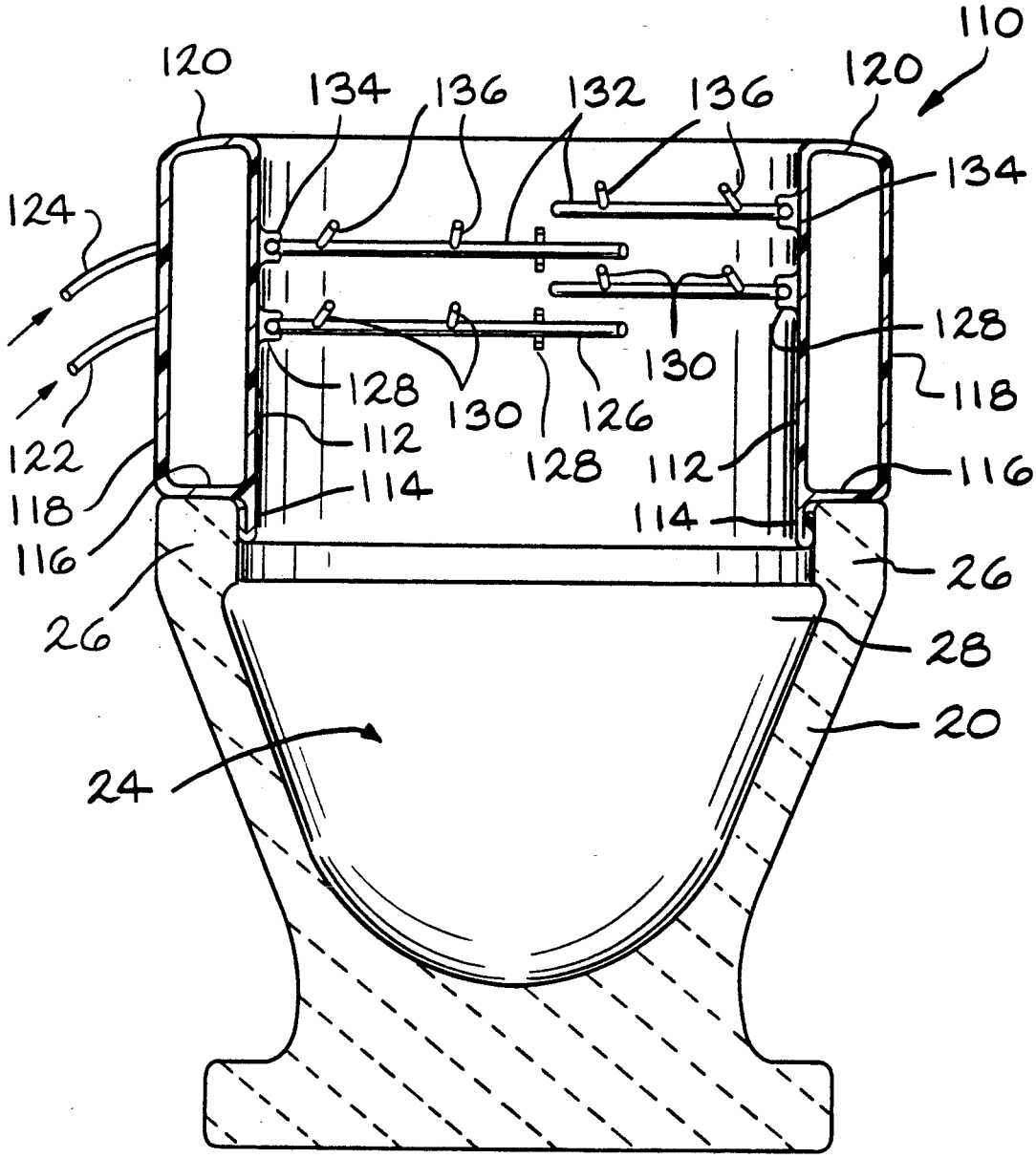

FIG. 4 is a cross-sectional view of another embodiment of a toilet seat 110 of the present invention.

GENERAL DESCRIPTION

The present invention relates to a seat apparatus that enables an individual to use a toilet having an excretion opening, which comprises: a support means removeably mountable on the toilet to support the individual over the toilet and the excretion opening, the support means comprising an inside sidewall between opposed open ends to form a passage through the support means, wherein when the seat apparatus is mounted on the toilet, the passage through the support means is in communication with the toilet excretion opening for enabling movement of excrement from the individual, through the support means passage and into the toilet, through the toilet excretion opening; and a wash means and an airflow drying means with at least one vent means mounted on the inside sidewall of the support means to direct a cleansing fluid and a drying airflow against the individual's buttocks for cleaning and drying the buttocks, wherein the wash means is used to clean the buttocks after the individual has finished excreting into the toilet and wherein the drying means is used to dry the buttocks after the buttocks have been cleaned by the wash means.

Furthermore, the present invention relates to a method for aiding an individual to excrete into a toilet having an excretion opening, which comprises: providing a seat apparatus, which comprises: a support means removeably mountable on the toilet to support the individual over the toilet and the excretion opening, the support means comprising an inside sidewall between opposed open ends to form a passage through the support means, wherein when the seat apparatus is mounted on the toilet, the passage through the support means is in communication with the toilet excretion opening for enabling the movement of excrement from the individual, through the support means passage and into the toilet through the toilet excretion opening; and a wash means and an airflow drying means with at least one vent means mounted on the inside sidewall of the support means to direct a cleansing fluid and a drying airflow against the individual's buttocks for cleaning and drying the buttocks; mounting the seat apparatus on the toilet so that the passage through the support means is in communication with the toilet excretion opening; seating the individual on the support means and having the individual excrete into the toilet, with the excrement moving through the support means passage and into the toilet through the toilet excretion opening; cleaning the individual's buttocks by using the wash means to direct the cleansing fluid against the buttocks after the individual has finished excreting into the toilet; and drying the individual's buttocks with the drying airflow from the drying means after the buttocks have been cleaned by the wash means.

SPECIFIC DESCRIPTION

FIGS. 1 to 3 show one embodiment of a self-contained personal hygiene apparatus 10 of the present invention. The personal hygiene apparatus 10 is a portable apparatus that serves to aid a person, particularly an invalid or debilitated person to excrete or otherwise relieve themself into a toilet or commode 12. The personal hygiene apparatus 10 is comprised of an invalid toilet seat 14, a hand actuated water pump 16 and a blower 18 as an airflow generating device. The toilet 12 is a conventional type and is comprised of a toilet bowl 20 having an associated water tank 22. The toilet bowl 20 has an interior 24 and an upper rim 26 forming an excretion opening 28 leading into the toilet interior 24.

The toilet seat 14 serves as a support means for the person and is removeably mounted on the toilet 12. Thus, the toilet seat 14 has a generally circular cross-section along and around a longitudinal axis A—A (FIG. 2) of the toilet seat 14 that provides a doughnut shape which mates with the upper rim 26 of the toilet bowl 20. As shown in cross-section in FIG. 3, the toilet seat 14 of the present invention is comprised of an annular inside sidewall 30 extending upwards from a lower open end 32 to an upper open end 34. An annular rim 36 extends outwardly from the inside sidewall 30, spaced above the lower open end 32 and forms a ledge that provides for mounting the toilet seat 14 on the upper rim 26 of the toilet bowl 20. A lower annular portion 38 of the inside sidewall 30 extends vertically downwardly into the toilet interior 24 to provide a splash guard for the lower open end 32 of the toilet seat 14.

The upper open end 34 of the toilet seat 14 has an enlarged circular cross-section provided by a bulbous portion 40 that is rounded towards the axis A—A. This provides the bulbous portion 40 with a curved upper surface 42 so that the person can comfortably sit on the toilet seat 14. As shown in cross-section in FIG. 2, the bulbous portion 40 is preferably provided with a plurality of uniformly spaced, radial stiffening ribs 44 (only one rib 44 is shown) that extend between an outside sidewall 46 of the bulbous portion 40 and the inside sidewall 30 (FIG. 3). The upper surface 42 can be provided with a spongy material, such as foam rubber, to provide added comfort when the person sits on the toilet seat 14. The bulbous portion 40 can also be made of a rigid material, such as a plastic or wood material. What is important is that the bulbous portion 40 provides a comfortable place to sit while also supporting the person over the excretion opening 28 of the toilet bowl 20.

As further shown in cross-section in FIG. 3, the toilet seat 14 is completed by an annular support member 48 that removeably mounts between the bulbous portion 40 and the upper side of the lower annular rim 36. The support member 48 has a sidewardly turned, elongate U-shaped cross-section formed of an upper annular web 50 with an annular outside sidewall 52 depending from an outer edge of the web 50 to the outer edge of a lower annular web 54. The upper annular web 50 mounts below the bulbous portion 40 while the lower annular web 54 mounts above the annular rim 36 resting on the upper rim 26 of the toilet bowl 20. This provides the toilet seat 14 with the generally doughnut shaped cross-section along and around the longitudinal axis A—A. The support member 48 thus serves as a brace for the toilet seat 14 to prevent the seat 14 from collapsing under the compression forces of the person sitting on the upper surface 42 of the bulbous portion 40 of the toilet seat 14.

To remove the support member 48 from the toilet seat 14, the support member 48 is separated along a seam (not shown) that normally faces the water tank 22. Constructing the support member 48 as a removeable section provides a means for entry into the interior of the support member 48 to access the water conduit 56 and the airflow conduit 58, which will hereinafter be explained in detail. It should be understood that while the support member 48 is preferably a removeable member, it can also be constructed as an integral part of the toilet seat 14.

As shown in FIGS. 1 and 2, the support member 48 is completed by a plurality of vertical brace members 60. The brace members 60 add structural support to the toilet seat 14 and extend radially inwardly from the outside sidewall 52 of the support member 48 towards the axis A—A, but spaced from the inside sidewall 30 of the toilet seat 14. The brace members 60 further extend longitudinally along the axis A—A of the toilet seat 14 between the upper web 50 and the lower web 54 of the support member 48. In addition to their strengthening function, the brace members 60 have a first, C-shaped opening 62 (FIG. 1) facing the axis A—A and a second, C-shaped opening 64 (FIG. 1) provided above the first C-shaped opening 62 and turned towards the axis A—A. The first C-shaped opening 62 provides for removeably mounting the water conduit 56 while the second C-shaped opening 64 provides for removeably mounting the airflow conduit 58.

As further shown in the Figures, the water conduit 56 supports a plurality of water nozzles 66 extending inwardly towards the axis A—A for venting a cleansing water jet (not shown) at the person's buttocks. A plurality of nozzle heads 68 are mounted on the water nozzles 66. The water nozzles 66 extend through openings 70 (FIGS. 2 and 3) provided through the inside sidewall 30 of the toilet seat 14 and are inclined upwardly towards the upper opening 34 of the toilet seat 14. Also, either the water nozzles 66 or the nozzle heads 68 or both can be provided with a pivotable joint (not shown) to adjust the direction of the water jet towards the person's buttocks sitting on the upper surface 42 of the bulbous portion 40 of the toilet seat 14. Grommets 72 are provided around each of the water nozzles 66 and help to seal and support the water nozzles 66 in the openings 70. The grommets 72 also help prevent water and other like substances from moving through the openings 70 and into the inside of the toilet seat 14. As will be explained in full detail hereinafter, the water conduit 56 along with the water nozzles 66 and the water pump 16 serve as a wash means for cleaning the person's buttocks.

In a similar manner as the water conduit 56 supporting the water nozzles 66, the airflow conduit 58 supports a plurality of airflow nozzles 74 that extend inwardly towards the axis A—A through openings 76 in the inside sidewall 30 of the toilet seat 14. The airflow nozzles 74 extend somewhat upwardly towards the upper opening 34 of the toilet seat 14 and provide for venting a drying airflow against the person's buttocks sitting on the upper surface 42 of the bulbous portion 40 of the toilet seat 14. The airflow nozzles 74 can be provided with a pivotable joint (not shown) to adjust the position of the airflow vented from the nozzles 74. Finally, the nozzles 74 are sealed in the openings 76 by grommets 78. The grommets 78 help prevent water, excrement and other like substances from moving through the openings 76 and into the inside of the toilet seat 14. The grommets 78 also help support the airflow nozzles 74 through the inside sidewall 30 of the toilet seat 14. As will be explained in full detail hereinafter, the airflow conduit 58 along with the airflow nozzles 74 and the blower 18 serve as a drying means for drying the person's buttocks.

As shown in FIG. 3, the distal end 58A of the airflow conduit 58 is provided with a flexible drain line 80 extending downwardly to a lower opening 30A provided through the inside sidewall 30 of the toilet seat 14. The drain line 80 is secured through the opening 30A by grommet 82 (FIG. 2) and ensures that any residual fluids that might enter the airflow conduit 58 through the nozzles 74 will drain out of the airflow conduit 58 and into the toilet bowl 20. To help this drainage, the airflow conduit 58 is inclined somewhat downwardly from the inlet end 58B of the airflow conduit 58 to the distal end 58A.

To provide the personal hygiene apparatus 10 as a portable apparatus, the water pump 16 is removeably connected to the toilet seat 14 by a first flexible water hose 84 extending to the water conduit 56 mounted inside the toilet seat 14. The water pump 16 is comprised of a lower cylindrical reservoir 86 that serves to hold a volume of water. The reservoir 86 is mounted on a stand 88 and is provided with an upper cylindrical cover 90 that mounts over the upper open end of the reservoir 86. A piston (not shown) is mounted inside the reservoir 86 and has a shaft 92 that extends through an upper wall 94 of the cover 90 to a handle 96. The handle 96 provides for actuating the piston when the handle 96 is depressed. The cover 90 is preferably removeably sealed over and around the reservoir 86 by an inner O-ring seal (not shown). This provides for removing the cover 90 from the reservoir 86 to repair any worn out parts inside the water pump 16. The cover 90 is also provided with a filler port 98 for filling the water pump 16 with water. The water pump 16 is preferably provided with a heater means (not shown) and temperature regulator for warming the water in the water pump 16 to a desired temperature.

Although not shown, it is contemplated by the scope of the present invention that the piston and handle 96 can be provided with a gearing mechanism that would multiply a downward force on the handle 96 to actuate the piston. This could be particularly useful for persons that lack the strength to actuate the piston without the gearing mechanism.

It is also contemplated by the scope of the present invention that the water pump 16 can be provided by an electric pump (not shown) that plugs into an electrical power source. When the person is finished excreting, the electric pump is turned on by the person to move a cleansing water flow through the water nozzles 66 and against the buttocks.

As particularly shown in FIG. 3, the water pump 16 is provided with a fitting 100 that mates with a first quick disconnect coupling 102 secured to one end of the water hose 84. Coupling 102 provides for connecting the water hose 84 to the water pump 16 while a similar, second quick disconnect coupling (not shown) provides for connecting the water hose 84 to the water conduit 56. Other coupling means are also contemplated by the scope of the present invention.

Similarly, the blower 18 is removeably connected to the toilet seat 14 by a second flexible air hose 104 having an enlarged proximal end 104A that mounts over the outlet duct 18A of blower 18 in a slip fitting relationship. The distal end 104B of air hose 104 connects to the inlet end 58B of the airflow conduit 58 mounted inside the toilet seat 14. The first and second flexible hoses 84 and 104 provide an easy and reliable means for disconnecting and connecting the toilet seat 14 to both the water pump 16 and the blower 18. This enables the personal hygiene apparatus 10 to be a portable apparatus that can be easily and quickly disassembled and packed into a travel bag (not shown). Thus the pump 16 has a piston means that is actuatable by hand. The container means for the piston is comprised of a hollow, cylindrical sidewall extending along and around a longitudinal axis of the container means from a bottom wall. The piston is in a closely spaced relationship with an inner surface of the sidewall of the container means and is provided with a handle means that is actuatable to actuate the piston means for moving the cleaning fluid from the container means to the first vent means for cleaning the buttocks. The personal hygiene apparatus 10 can then be carried along with the invalid person's other personal effects and belongings. This greatly increases the mobility of the invalid person and allows the person to lead a normal and active life, without the fear of being unable to relieve themself in a bathroom, especially a foreign bathroom.

IN USE

The portable, personal hygiene apparatus 10 is removed from its carrying case or carrying bag (not shown) when the person desires to relieve themself. The water pump 16 is first filled with water through filler port 98. If the water pump 16 does not have the filler port 98, the cover 90 can be removed from the reservoir portion 86 so that the reservoir 86 can be filled with water. With the handle 96 in an upper position, (FIG. 3), the cover 90 is resealed on the reservoir 86 by the internal O-ring (not shown), as previously discussed. The water hose 84 is then connected to the water pump 16 by the first quick disconnect coupling 102 and to the toilet seat 14 by the second quick disconnect coupling (not shown) to provide the wash means for the hygiene apparatus 10.

The blower 18, which is preferably a hand held hair dryer device, is next attached to the toilet seat 14 by connecting the enlarged proximal end 104A of the air hose 104 to the outlet duct 18A of the blower 18. The distal end 104B of the air hose 104 is similarly connected to the inlet end 58B of the air conduit 58 mounted inside the toilet seat 14. This provides the drying means for the hygiene apparatus 10. A power cord 106 is provided for connecting the blower 18 to a power source (not shown) and an on/off switch (not shown) is provided for actuating the blower 18.

The toilet seat 14 is then mounted on the upper rim 26 of the toilet bowl 20, as has already been described in detail. The person sits on the upper surface 42 of the bulbous portion 40 of the toilet seat 14 and relieves themself into the toilet 12 through the excretion opening 28. When the person is finished excreting, the person actuates the wash means by depressing the handle 96 of the water pump 16. This causes the water held in the reservoir 86 of the water pump 16, to move through the water hose 84, into the water conduit 56 mounted inside the toilet seat 14 and through the water nozzles 66 to exit the water nozzle heads 68 as a cleansing water flow. The water nozzles 66 have been previously angled upwards towards the upper open end 34 of the toilet seat 14 so that the cleansing water flow is directed towards the person's buttocks to clean the buttocks. The hand operated water pump 16 enables the person to regulate the pressure of the water flowing from the nozzle heads 68 and against the buttocks.

It is also contemplated by the scope of the present invention that the water hose 84 can be connected to a water faucet (not shown) as the water source. In this case, the person would turn on the water faucet to provide the water flow to the water nozzle heads 68 as the cleansing water flow. In this case, it is preferred that the water hose 84 have an inline, adjustable flow regulator to control the rate of flow of the water through the water hose 84 and against the buttocks.

After the buttocks have been thoroughly cleaned by the cleansing water flow from the wash means, the blower 18 is actuated. The airflow from the blower 18 flows through the air hose 104 and into the airflow conduit 58, mounted inside the toilet seat 14. From there, the airflow travels through the plurality of airflow nozzles 74, which direct the airflow against the person's buttocks This serves as the drying means for the buttocks. The blower 18 is preferably provided with a heater device for heating the airflow, although this is not necessary. If the blower 18 does have a heater, there should also be a regulator device for controlling the temperature of the heated airflow exiting the blower 18. The blower 18 can also be provided with a volume control for regulating the amount of airflow directed against the person's buttocks.

After the person's buttocks have been thoroughly cleaned and dried, the portable hygiene apparatus 10 can be disassembled and packed back into its travel case (not shown). To disassemble the hygiene apparatus 10, the airflow hose 104 is disconnected from the blower 18 and the airflow conduit 58 mounted in the toilet seat 14. The water hose 84 is also disconnected from the water pump 16 and the water conduit 56 mounted in the toilet seat 14. If there is any water remaining in the water pump 16, it should be emptied at this time to prevent the water from spilling or leaking from the water pump 16. Also, if there is any excrement or the like on the inside annular sidewall 30 of the toilet seat 14, now is the time to clean it off the toilet seat Once packed back in its travel case, the portable hygiene apparatus 10 can be transported along with the invalid person's other personal effects and belongings. In addition to enabling an invalid person to excrete or otherwise relieve themself in a bathroom, personal hygiene apparatus 10 reduces the person's dependence on the presence of an attendant to help them when they desire to relieve themself. This greatly increases the mobility of the invalid person because they can now be much more independent with respect to attending to their own personal hygiene needs. It should be understood that the personal hygiene apparatus 10 can also be used by a person who is not an invalid.

FIG. 4 shows another embodiment of a toilet seat 110 for the personal hygiene apparatus 10 of the present invention. The toilet seat 110 is provided as an integral unit and is comprised of an annular inside sidewall 112 having a lower annular rim 114 mounted inside the upper rim 26 of the toilet bowl 20. A lower annular web 116 extends outwardly from the upper edge of the lower annular rim 114 and provides for mounting the toilet seat 110 on the annular rim 26 of the toilet bowl 20. An annular outside sidewall 118 meets the outer edge of the web 116 and extends upwardly to an upper web 120 that connects between the outside sidewall 118 and the inside sidewall 112 to complete the toilet seat 110.

The toilet seat 110 is provided with a first, water hose 122 and a second, airflow hose 124 that connects to the respective water pump 16 and blower 18, as previously discussed. The water hose 122 is detachably connected (not shown) to a water conduit 126 that is removeably mounted on the inside sidewall 112 of the toilet seat 110 by a plurality of C-shaped brackets 128 that snappingly receive the water conduit 126. This provides for removing the water conduit 126 from the brackets 128 for cleaning the conduit 126 and brackets 128. Although the C-shaped brackets 128 are preferred, other attachment means such as U-brackets attached to the inside sidewall 112 are also contemplated by the scope of the present invention. The water conduit 126 extends around the perimeter of the inside sidewall 112 and has a plurality of water nozzles 130 angled in an upwardly direction. When the water hose 122 is connected to the water pump 16, the nozzles 130 serve to direct the cleansing fluid moved from the water pump 16 against the person's buttocks for cleaning the buttocks.

In a similar manner as the water hose 122 connected to the water conduit 126, the airflow hose 124 is detachably connected to an airflow conduit 132 that is removeably mounted on the inside sidewall 112 of the toilet seat 110 by a plurality of C-shaped brackets 134 or other suitable mounting means that snappingly receive the airflow conduit 132. This provides for removing the airflow conduit 132 from the brackets 134 for cleaning the conduit 132 and brackets 134. The airflow conduit 132 extends around the perimeter of the inside sidewall 112 and has a plurality of airflow nozzles 136 angled in an upwardly direction. When the airflow hose 124 is connected to the blower 18, the nozzles 136 serve to direct the drying airflow from the blower 18, against the person's buttocks for drying the buttocks.

It should be noted that while it is preferred that the water hose 122 be detachably connected to the water conduit 126 mounted inside of the toilet seat 110, it is contemplated by the scope of the present invention that the water conduit 126 and the water hose 122 can be one continuous water hose 122. The water hose 122 can then be detachably connected to the water pump 16 so that the water hose 122 can be rolled up and transported along with the toilet seat 110. Similarly, the airflow conduit 132 and the airflow hose 124 can be one continuous airflow hose 124 that is detachably connected to the blower 18. The airflow hose 124 can then be rolled up and transported along with the toilet seat 110. In use, the toilet seat 110 operates in a similar manner as that previously described with respect to the toilet seat 10.

It is also contemplated by the scope of the present invention that the water hose 122 and the airflow hose 124 can lead into a central Y connection that connects to a single hose mounted on the inside sidewall 112 of the toilet seat 110 in a similar manner as the water conduit 126 and the airflow conduit 132. The single hose would have a plurality of nozzles that would serve as vent means for both the wash means and the drying means. A three-way valve would be provided at the connection between the water hose 122 and the air hose 124 for switching between the wash means and the drying means.

It is intended that the foregoing descriptions be only illustrative of the present invention and that the present invention be limited only by the hereinafter appended claims.

I claim:

1. A portable seat apparatus that enables an individual to use a toilet having an excretion opening, which comprises:

(a) a support means having opposed open ends, wherein the opposed ends of the support means are spaced apart to provide a height of the support means, said support means being removeably mountable on the toilet around the excretion opening to support the individual over the toilet and the excretion opening, the support means comprising an inside sidewall extending between the opposed open ends of the support means to form a passage through the support means and an outside sidewall spaced from and connected to the inside sidewall at the opposed ends, the inside and outside sidewalls being sized to extend above the excretion opening when the support means is mounted on the toilet with the passage through the support means in communication with the toilet excretion opening for enabling movement of excrement from the individual, through the support means passage and through the toilet excretion opening, and wherein an annular portion of the inside sidewall of the lower end of the support means is sized to extend into and around the toilet excretion opening to provide a splash guard between the excretion opening and the support means; and (b) a wash means and an airflow drying means each having at least one vent and mounted on the inside sidewall of the support means for directing a cleansing fluid and a drying airflow against the individual's buttocks for cleaning and drying the buttocks wherein the wash means is used to clean the buttocks after the individual has finished excreting into the toilet and wherein the drying means is used to dry the buttocks after the buttocks have been cleaned by the wash means.

2. The seat apparatus of claim 1 wherein the airflow drying means is comprised of a hand held airflow generating means that provides the drying airflow for drying the buttocks.

3. The seat apparatus of claim 2 wherein the airflow generating means is a hair dryer provided with a heating means for heating the airflow directed against the buttocks.

4. The seat apparatus of claim 1 wherein the vents are comprised of a first vent means communicating through the inside sidewall of the support means for directing a cleansing fluid against the individuals buttocks for cleaning the buttocks and a second vent means communicating through the inside sidewall of the support means for directing a drying airflow against the individuals buttocks for drying the buttocks.

5. The seat apparatus of claim 4 wherein the first vent means is connected to a container means holding the cleansing fluid and wherein the container means is provided with a pump means for moving the cleansing fluid from the container means, through the first vent means and against the buttocks for cleaning the buttocks.

6. The seat apparatus of claim 5 wherein the pump means is actuatable by hand for moving the cleansing fluid from the container means to the first vent means for cleaning the buttocks.

7. The seat apparatus of claim 6 wherein the pump means is provided with a handle means that is actuatable for moving the cleaning fluid from the container means to the first vent means for cleaning the buttocks.

8. The seat apparatus of claim 5 wherein the container means is connected to the first vent means by a flexible conduit means that extends between the container means and the first vent means to provide a connection between the container means and the first vent.

9. The seat apparatus of claim 4 wherein the first vent means is comprised of a plurality of first nozzle means spaced around the perimeter of the inside sidewall of the support means to provide for directing the cleansing fluid against the buttocks as the wash means and wherein the second vent means is comprised of a plurality of second nozzle means spaced around the perimeter of the inside sidewall of the support means to provide for directing the drying airflow against the buttocks to dry the buttocks with the drying means.

10. The seat apparatus of claim 1 wherein the support means is made of a plastic material.

11. A method for aiding an individual to excrete into a toilet having an excretion opening, which comprises:

(a) providing a portable seat apparatus, which comprises: a support means having opposed open ends, wherein the opposed ends of the support means are spaced apart to provide a height of the support means, said support means being removeably mountable on the toilet around the excretion opening to support the individual over the toilet and the excretion opening, the support means comprising an inside sidewall extending between the opposed open ends of the support means to form a passage through the support means and an outside sidewall spaced from and connected to the inside sidewall at the opposed ends, the inside and outside sidewalls being sized to extend above the excretion opening when the support means is mounted on the toilet with the passage through the support means in communication with the toilet excretion opening for enabling movement of excrement from the individual, through the support means passage and through the toilet excretion opening, and wherein an annular portion of the inside sidewall of the lower end of the support means is sized to extend into and around the toilet excretion opening to provide a splash guard between the excretion opening and the support means; and a wash means and an airflow drying means each having at least one vent and mounted on the inside sidewall of the support means for directing a cleansing fluid and a drying airflow against the individual's buttocks for cleaning and drying the buttocks;

(b) mounting the seat apparatus on the toilet so that the passage through the support means is in communication with the toilet excretion opening;

(c) seating the individual on the support means and having the individual excrete into the toilet, with the excrement moving through the support means passage and into the toilet through the toilet excretion opening;

(d) cleaning the individual's buttocks by using the wash means to direct the cleansing fluid against the buttocks after the individual has finished excreting into the toilet; and (e) drying the individual's buttocks with the drying airflow from the drying means after the buttocks have been cleaned by the wash means.

12. The method of claim 11 wherein the seat apparatus is moved from a first toilet to a second toilet and the individual excretes into the second toilet with the aid of the seat apparatus.

13. The method of claim 11 wherein the drying means is comprised of a hand held airflow generating means that provides the drying airflow for drying the buttocks.

14. The method of claim 13 wherein the vents are comprised of a first vent means communicating through the inside sidewall of the support means for directing a cleansing fluid against the individuals buttocks for cleaning the buttocks and a second vent means communicating through the inside sidewall of the support means for directing a drying airflow against the individuals buttocks for drying the buttocks and wherein after the individual has finished excreting into the toilet, the wash means is actuated by the individual to move the cleansing fluid through the first vent means and against the buttocks to clean the buttocks and wherein the airflow generating means is then actuated by the individual to move the drying airflow against the buttocks, through the second vent means to dry the buttocks after the buttocks have been cleaned by the wash means.

15. The method of claim 14 wherein the first vent means is connected to a container means holding the cleansing fluid and wherein the container means is provided with a pump means for moving the cleansing fluid from the container means to the first vent means and wherein after the individual has finished excreting into the toilet, the pump means is actuated by the individual to clean the buttocks by moving the cleansing fluid from the container means, through the first vent means and against the buttocks.

16. The method of claim 15 wherein the pump means is actuatable by hand as a hand pump means for moving the cleansing fluid from the container means to the first vent means and wherein after the individual has finished excreting into the toilet, the hand pump means is actuated by the individual to move the cleansing fluid against the buttocks to clean the buttocks.

17. The method of claim 16 wherein the pump means is provided with a handle means that is actuated by the individual to actuate the hand pump means and wherein after the individual is finished excreting into the toilet, the handle means of the hand pump means is actuated to move the cleansing fluid from the container means to the first vent means for cleaning the buttocks.

18. The method of claim 16 wherein the container means is connected to the first vent means by a flexible conduit means that extends between the container means and the first vent means to provide a connection between the container means and the first vent means and wherein after the individual is finished excreting into the toilet, the pump means is actuated by the individual which causes the cleansing fluid to move from the container means, through the conduit means and to the first vent means and then against the buttocks to clean the buttocks.

19. The method of 16 wherein the first vent means is comprised of a plurality of first nozzle means spaced around the perimeter of the inside sidewall of the support means for cleaning the buttocks and wherein the second vent means is comprised of a plurality of second nozzle means spaced around the perimeter of the inside sidewall of the support means for drying the buttocks and wherein after the individual has finished excreting into the toilet, the wash means is actuated by the individual to move the cleansing fluid through the plurality of first nozzle means to wash the buttocks and wherein after the buttocks are cleaned, the airflow generating means is actuated by the individual to move the drying airflow against the buttocks, through the plurality of second nozzle means for drying the buttocks with the drying means.

20. The method of claim 13 wherein the airflow generating means is a hair dryer means provided with a heater means to heat the airflow and wherein after the individual's buttocks have been cleaned with the wash means, the buttocks are dried with the individual actuating the airflow generating means to direct the heated airflow through the inside sidewall of the support means and against the buttocks as the drying means.

21. The method of claim 11 wherein the support means is made of a plastic material.

* * * * *